US006968725B2

(12) United States Patent
Harsch et al.

(10) Patent No.: US 6,968,725 B2
(45) Date of Patent: Nov. 29, 2005

(54) FLEXIBLE TRANSPORTING APPARATUS FOR PRESSES

(75) Inventors: Erich Harsch, Weingarten (DE); Rainer Reichenbach, Schlier (DE)

(73) Assignee: Mueller Weingarten AG, Weingarten (DE)

( * ) Notice: Subject to any disclaimer, the term of this patent is extended or adjusted under 35 U.S.C. 154(b) by 0 days.

(21) Appl. No.: 09/767,689

(22) Filed: Jan. 24, 2001

(65) Prior Publication Data

US 2002/0029701 A1 Mar. 14, 2002

(30) Foreign Application Priority Data

Feb. 29, 2000 (DE) ..... 100 09 574

(51) Int. Cl.[7] ..... B21D 43/05
(52) U.S. Cl. ..... 72/405.09; 72/405.1; 72/405.01
(58) Field of Search ..... 72/405.1, 405.2, 72/405.02, 405.13, 405.16, 405.11, 405.12, 72/405.09, 405.01; 100/207, 140

(56) References Cited

U.S. PATENT DOCUMENTS 5,582,061 A * 12/1996 Harsch et al. ..... 72/405.1
5,584,205 A * 12/1996 Harsch et al. ..... 72/405.02
5,632,181 A 5/1997 Vanderzee et al. ..... 72/405.1
5,727,416 A * 3/1998 Allgoewer ..... 72/405.01
5,865,058 A * 2/1999 VanderZee et al. ..... 72/405.08
5,979,212 A * 11/1999 VanderZee et al. ..... 72/405.09
6,223,582 B1 * 5/2001 Hofele et al. ..... 72/405.9

FOREIGN PATENT DOCUMENTS

| | | | |
|---|---|---|---|
| DE | 44 08 449 A1 | 9/1995 | |
| DE | 4408449 A1 | 9/1995 | ..... B21D 43/05 |
| DE | 196 51 934 A1 | 6/1998 | |
| EP | 0 383 168 B1 | 8/1990 | |
| EP | 0 672 480 A1 | 9/1995 | |
| EP | 0 693 334 A1 | 1/1996 | |
| EP | 0693334 A1 | 1/1996 | ..... B21D 43/10 |

* cited by examiner

*Primary Examiner*—Derris H. Banks
*Assistant Examiner*—Jimmy T. Nguyen
(74) *Attorney, Agent, or Firm*—Hogan & Hartson L.L.P.

(57) ABSTRACT

The invention proposes a transporting apparatus for transporting single or double workpieces through processing stations of presses, in which apparatus up to 9 degrees of freedom are integrated in the transporting system. Necessary changes in position for, for example, feeding into dies can take place directly by way of the transporting apparatus. It is possible to dispense with intermediate set-down locations or orienting stations.

10 Claims, 4 Drawing Sheets

3.2
2.2
13
5
13
5
13
15
14
2.1
3.1

FLEXIBLE TRANSPORTING APPARATUS FOR PRESSES

FIELD OF THE INVENTION

The invention relates to a press line or multi-stage press for large components, having a transporting apparatus for transporting workpieces.

BACKGROUND OF THE INVENTION

In a press, press line or multi-stage press for large components, transfer apparatuses are provided for transporting workpieces into the processing stages. In recent systems according to EP 0 672 480 B1 or EP 0 693 334 A1, the transporting operation between individual processing stations takes place individually by individual transporting apparatuses, which allow, in particular, a high flexibility of the capacity for movement of the workpiece transportation between individual processing stages. By means of such a drive, which is fully independent of the central drive of the press, it is possible to optimize the transportation of the workpiece in a number of degrees of freedom, in particular in relatively large press installations. For this purpose, you are referred to EP 0 672 480 or EP 0 693 334. By way of example, carrying rails, on which carriages with dedicated drive travel, are provided over the entire press length. For accommodating the workpieces, use is made of crossmembers which are provided with retaining means and are each fastened on 2 opposite carriages. In the most straightforward embodiment, 2 transporting movements are provided for transferring the workpieces, to be precise a vertical movement and a horizontal movement. The vertical movement serves for removing the workpiece from the bottom die part or depositing the workpiece in the same, while the horizontal movement provides the actual transporting step. This transporting step can take place from one press into the following press or, in the case of a multi-stage press for large components, from one forming station into the next.

However, it is usually the case that the workpieces and/or dies are not of such straightforward configuration as to allow transportation in biaxial operation. By way of example, in the case of passenger-vehicle doors, the latter, in the first forming stage, are drawn from a common blank in order then, following a cutting operation, to run, each as separate workpieces, through the processing stages together. In order to avoid more expensive and complicated dies, it is necessary for the workpiece to be brought into an optimum processing position during the transfer operation. This change in position is usually carried out by way of intermediate set-down locations or orienting stations.

Such an intermediate set-down location, both for single and for double components, is disclosed by EP 0 383 168 B1 or DE 196 51 934 A1. Of particular note are the 5 degrees of freedom which can be used for changing the position of workpieces of complex configuration. It is thus possible, if required, for the position of the workpiece to be manipulated in 5 axes.

Essential disadvantages of this functionally satisfactory intermediate set-down location are as follows:

- the press installation or multi-stage press for large components requires a long overall length since the intermediate set-down locations are arranged between the processing stages and the appropriate amount of space thus has to be provided.
- The number of workpiece-specific changeover parts is high.

- The parked position of the crossmembers during the forming operation is restricted.
- The cycle speed and functional reliability of the press may be adversely affected by the relatively large number of transporting steps.

This resulted in considerations to dispense with the intermediate set-down location and to integrate the necessary degrees of freedom in the transporting systems. It is thus proposed, [lacuna] DE 44 08 449 A1, to configure the transporting system such that the crossmember can be brought into a sloping position in the vertical direction. It is additionally possible to pivot an axis in the direction transverse to the transporting direction.

Some of the possible movements of the intermediate set-down location have thus been integrated in the transporting system, but the full functionality of this intermediate set-down location has not.

SUMMARY OF THE INVENTION

Taking the prior art as the departure point, the object of the invention is to propose a transporting system for forming machines which has the highest possible number of degrees of freedom or movement axes.

This object is achieved, taking as the departure point a transporting system in accordance with the invention as described below. Adantages of the invention as described in the description below and in view of the claims.

The invention is based on the idea of configuring a separately driven transfer for each die stage such that workpieces can undergo an optimum change in position adapted to the forming process in each case.

By way of example, the change in position may include the following movement axes:

- horizontal displacement in and counter to the transporting direction
- sloping position in the transporting direction
- displacement in the direction transverse to the transporting direction
- pivoting in and counter to the transporting direction
- pivoting in the direction transverse to the transporting direction
- vertical change in height By a different combination of the movements, the change in position is made possible during introduction of the workpieces into the die and removal of the workpieces from the die.

Provision is made here to ensure the functionality both for individual large-surface-area workpieces and for 2 workpieces, that is to say so-called double components.

In the case of the design, taking as departure point the known individually driven, crossmember-bearing transporting systems, such as carriages, slides, pivoting arm, telescopic arm, etc., the number of movement axes is increased by additional drives and movement-transmissions. By using spherical mountings, such as ball and socket joints or universal joints, a sloping position of the crossmember is also made possible.

Further details and advantages of the invention can be gathered from the following description of an exemplary embodiment.

The higher-outlay solution of transporting double components has been selected for the exemplary embodiment. If, however, the task is to transport just one large-surface-area workpiece rather than a double component, the crossmember is replaced by the sucker crossmember. This function is achieved by the attachment of die-specific transporting and retaining means to the crossmember.

DETAILED DESCRIPTION OF THE INVENTION

Figure 1:
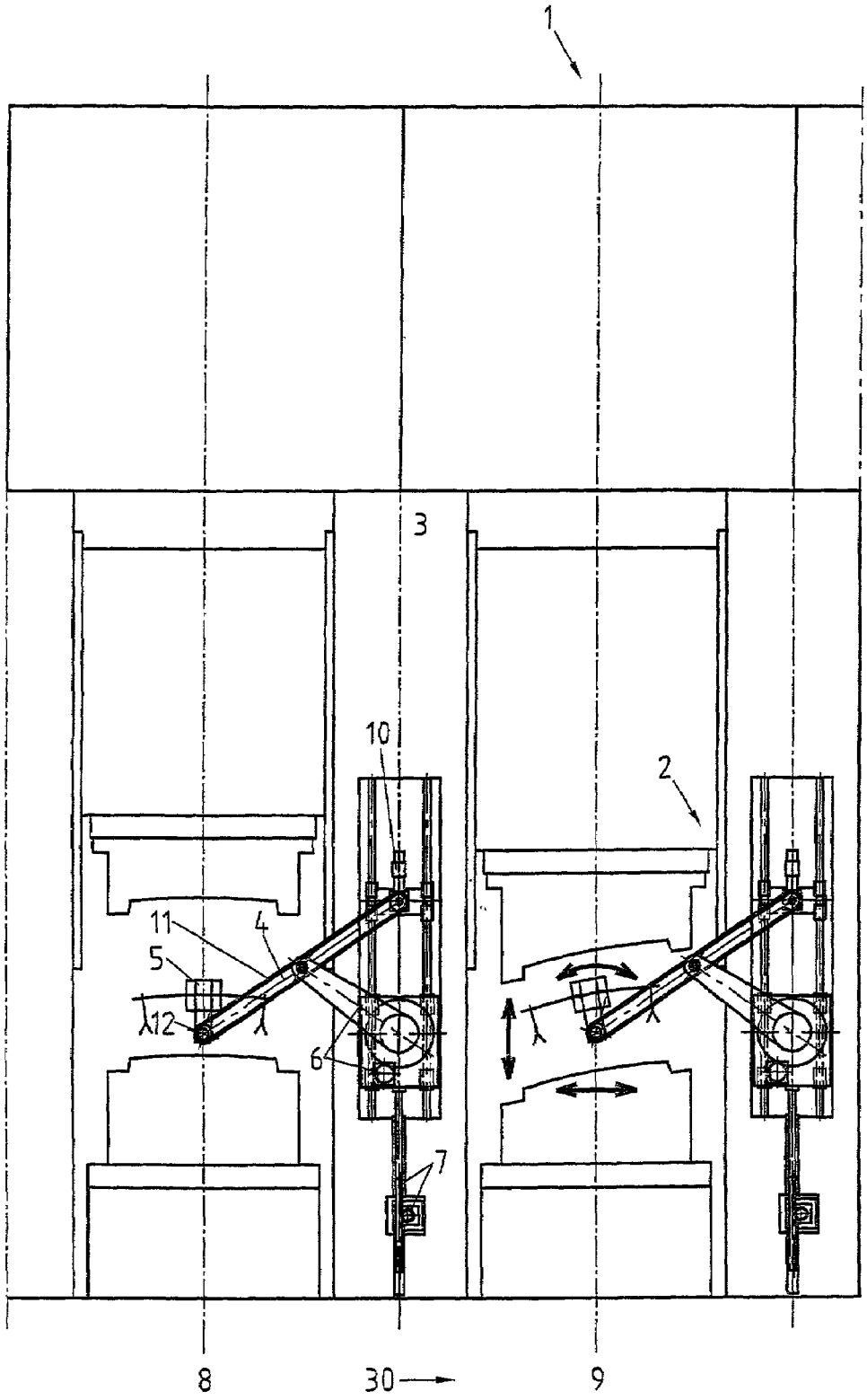
FIG. 1 shows part of a multi-stage press for large components.

Processing stations or forming stages 8, 9 of a multi-stage press for large components 1 are illustrated in FIG. 1. Arrow 30 shows the transporting direction of the workpieces. The transporting apparatus 2 is arranged on the press upright 3 and also mirror-invertedly on the opposite upright. The transporting apparatus 2 is driven by pivot drive 6, which is in operative connection with pivoting arm 4. The crossmember, which is provided for workpiece-transporting purposes, is designated 5 and is mounted on the pivoting arm 4. This figure shows, in particular, the following degrees of freedom

- vertical movement
- horizontal movement
- crossmember 5 pivot [sic] in and counter to the transporting direction Via the pivoting drive 6, in operative connection with a lifting drive 7, by virtue of a combination of movements, a transporting curve or a transporting step comprising vertical and horizontal movements is executed. The transporting step serves for transferring the workpiece from, for example, forming stage 8 to forming stage 9. If a change in position of the workpieces, on account of different removal and feeding positions, and thus better introduction and delivery is necessary, the crossmember 5 can be pivoted about the axis of rotation 12. A drive 10 causes the crossmember 5 to pivot via a toothed-belt drive 11. Different positions of the crossmember 5 can clearly be seen in FIG. 1.

Figures 2A, 2B:
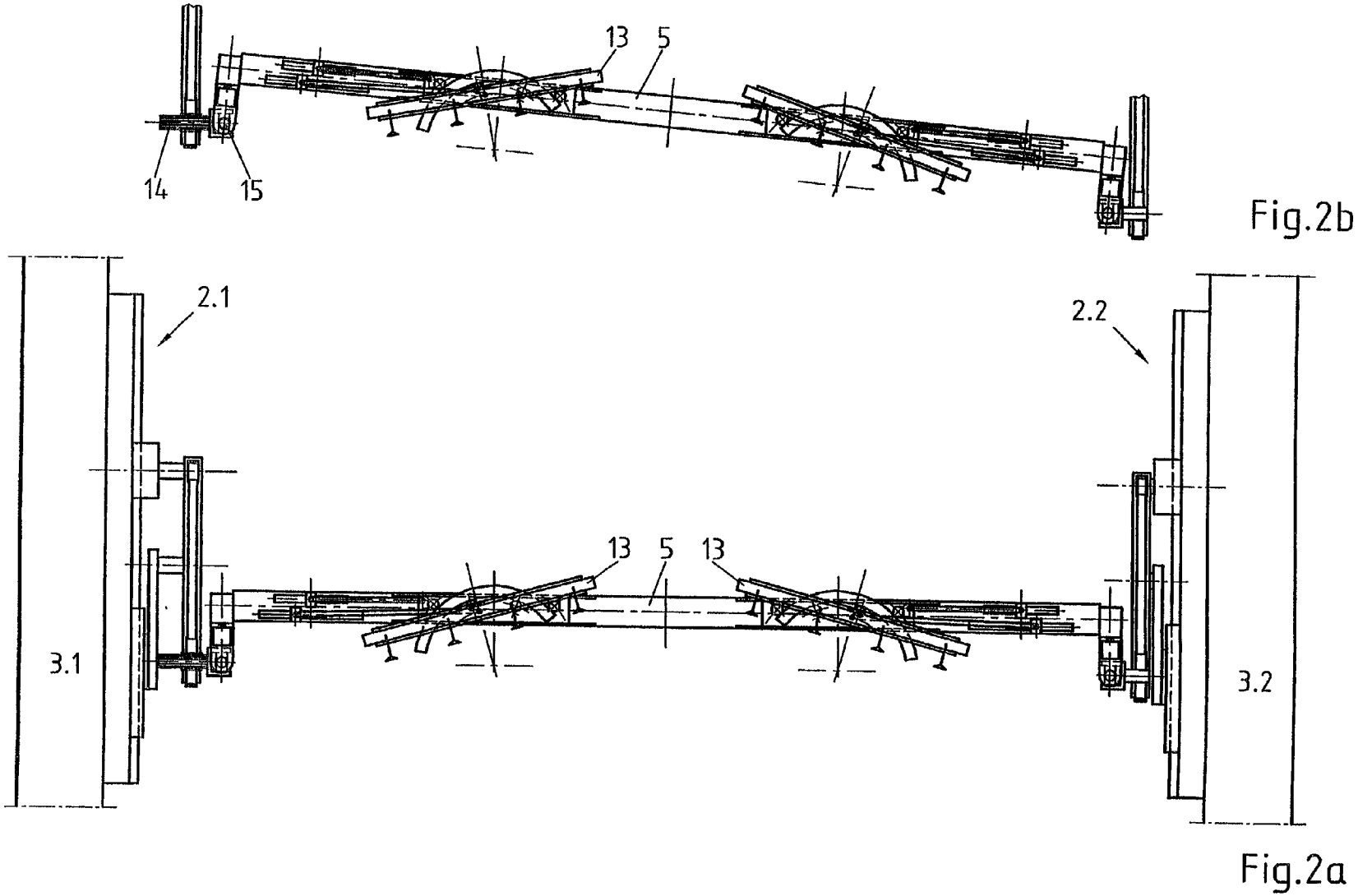
FIGS. 2*a*, 2*b* show a view of a transporting unit in the direction transverse to the transporting direction.

The illustration in FIGS. 2*a+b* shows crossmember 5 in a horizontal position and in a vertically sloping position. The figures show the mutually opposite arrangement of the transporting apparatuses 2.1 and 2.2 with fastening on the left-hand and right-hand uprights 3.1 and 3.2. Movably arranged workpiece-specific sucker crossmembers 13 for transporting double components are provided on the crossmember 5 by way of example in FIGS. 2*a+b*. It is also possible, without any restrictions, to use just one centrally arranged sucker crossmember 13, as is necessary, for example, for transporting a large, not yet divided blank or a large workpiece. In this case, the suckers are connected directly, as changeover parts, to crossmember 5. A transverse-displacement movement may be provided.

The following degrees of freedom are illustrated in FIGS. 2*a+b:*

- pivoting the sucker crossmember 13 in the direction transverse to the transporting direction in the case of double components
- horizontal and sloping position in the vertical direction of the crossmember 5.

Figure 3B:
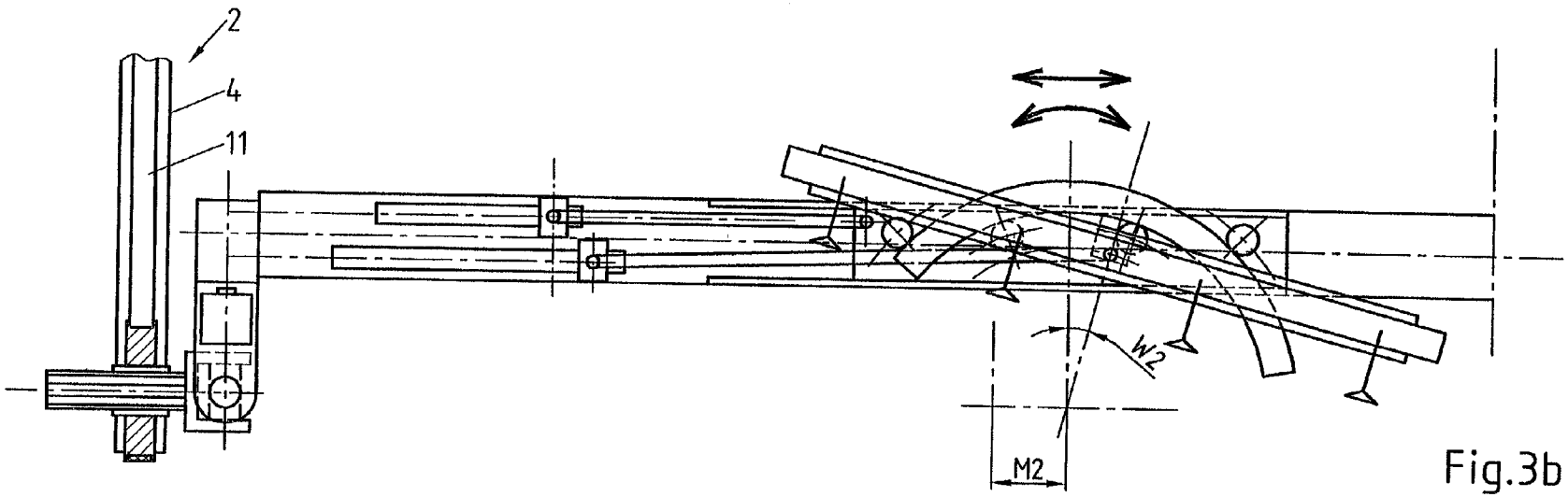
FIGS. 3*a*, 3*b* show a detail from FIG. 2, and FIGS. 4*a*, 4*b* show a plan view of the transporting unit.
Figure 3A:
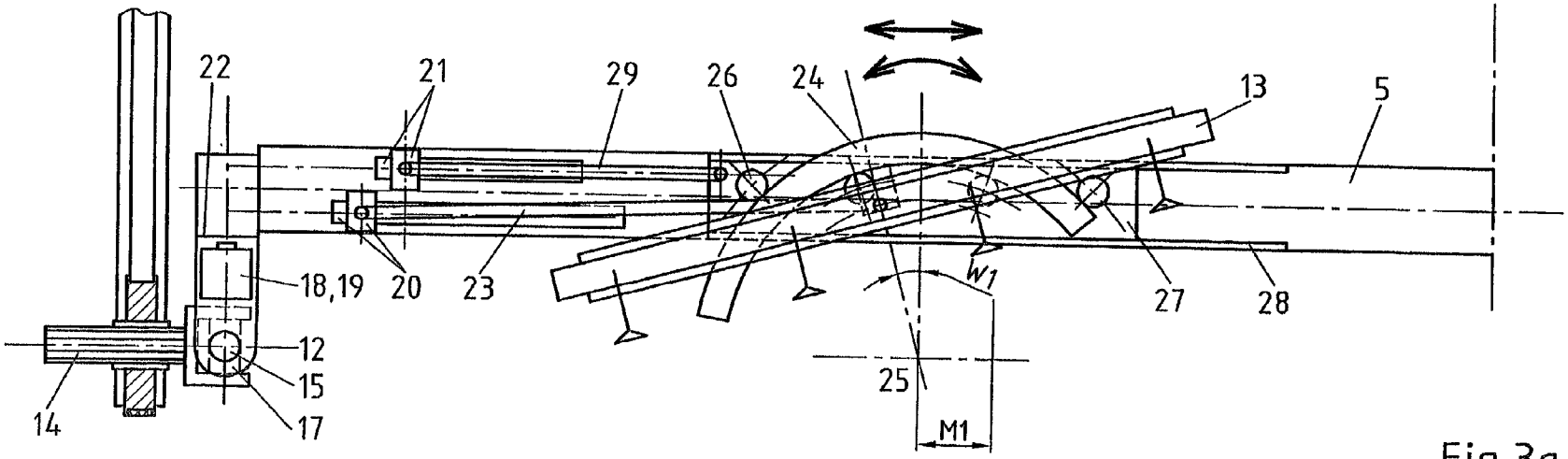

The pivoting of the sucker crossmember 13 is described in more detail in FIGS. 3*a+b*.

The vertically sloping position of the crossmember 5 is achieved by different movement sequences of transporting apparatus 2.1 and 2.2. For the compensation in length which is required by the sloping position according to FIG. 2*b*, a spline shaft 14 is provided. The universal joint 15 allows the angled position of the crossmember 5. Instead of a universal joint 15, an axis of rotation is also initially sufficient for this sloping position.

FIGS. 3*a+b* show design details for pivoting the sucker crossmember 13. The following is also illustrated as a further degree of freedom:

transverse displacement of the sucker crossmember 13

FIGS. 3*a+b* show the end of the pivoting arm 4 of the transporting apparatus 2 with the mount for the crossmember 5. The toothed-belt drive 11 is integrated in the transporting apparatus 2 in order to pivot the crossmember 5 about the axis of rotation 12. The spline shaft 14, on the one hand, transmits the rotational movement and, in addition, allows the compensation in length for the sloping position of the crossmember 5. The spline shaft 14 is fastened to the universal joint 15. The pivotable bearing block 17 bears drives 18, 19, which drive spindle/nut system 20 and 21 via shafts and angular gear mechanisms. Rods 23 arranged on both sides are in operative connection with spindle/nut system 20 and are connected to circle segment 24 and pivot the latter at the point of rotation 25. The maximum size of the pivoting angle is W1 and W2. The circle segment 24 is guided and supported by segment guides or guide rollers 26, which are fastened on horizontal slide 27. The workpiece-retaining sucker crossmember 13 is connected to the circle segment 24. Guides 28 serve for guiding the horizontal slide 27. Said horizontal slide 27 can be displaced by the distance M1 and M2 in relation to its central position. Horizontal slide 27 is driven, via rod 29 and spindle/nut system 21, by drive 19. This apparatus described may be fitted on the crossmember 5 on its own or as one of two. The combination of movements is possible by simultaneous actuation of the drives 18, 19. The rotational-speed regulation may result in the same or different rotational speeds, as a result of which optimum conditions for handling the workpieces are achieved. This high flexibility may also be advantageous during die changeover, where, if appropriate, it is possible to dispense with the exchange of the component-specific sucker crossmember 13 and to execute just a horizontal movement. If, however, an exchange of the sucker crossmembers 13 is necessary, then all the movement elements on crossmember 5 remain.

The crossmember 5 can be disengaged at the separating location 22, as may be necessary, for example, during a conversion from a double component to a large-surface-area single component. Advantageously, in the arrangement proposed, there is no need to exchange the drives 18, 19, and these remain in the press 1.

A combination of pivoting and horizontal displacement of the sucker crossmember 13 is not absolutely necessary in every case. Alternatively, the attachment may be such that only one movement is possible in each case, i.e. the slide 27 or the circle segment 24 may then be dispensed with.

Figure 4B:
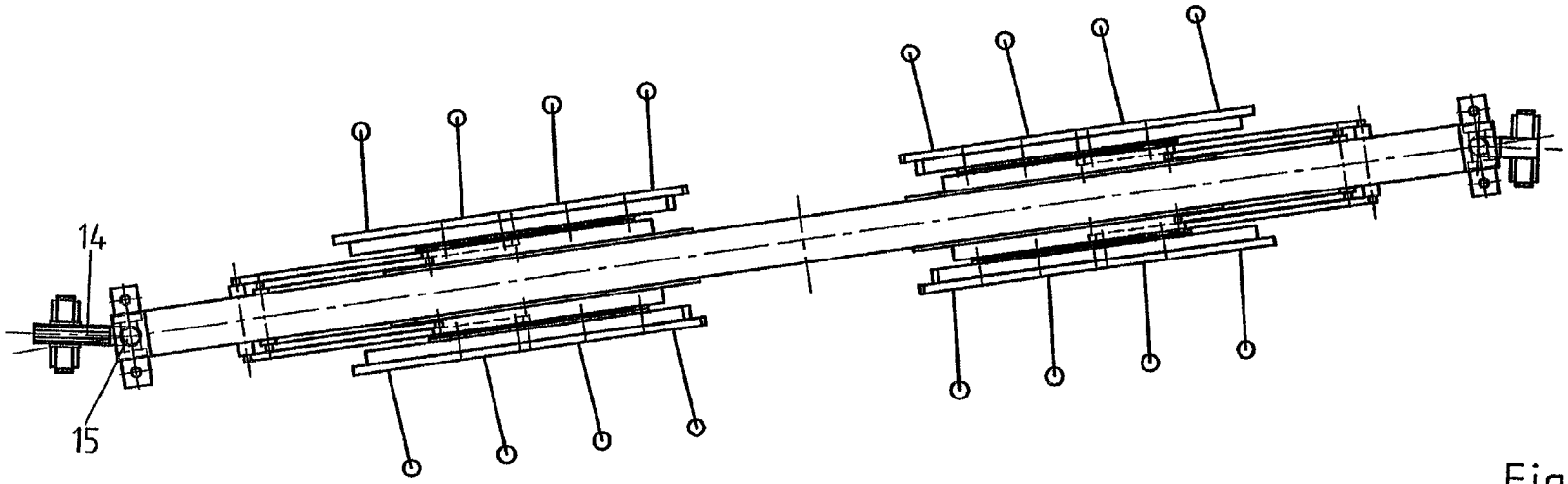
Figure 4A:
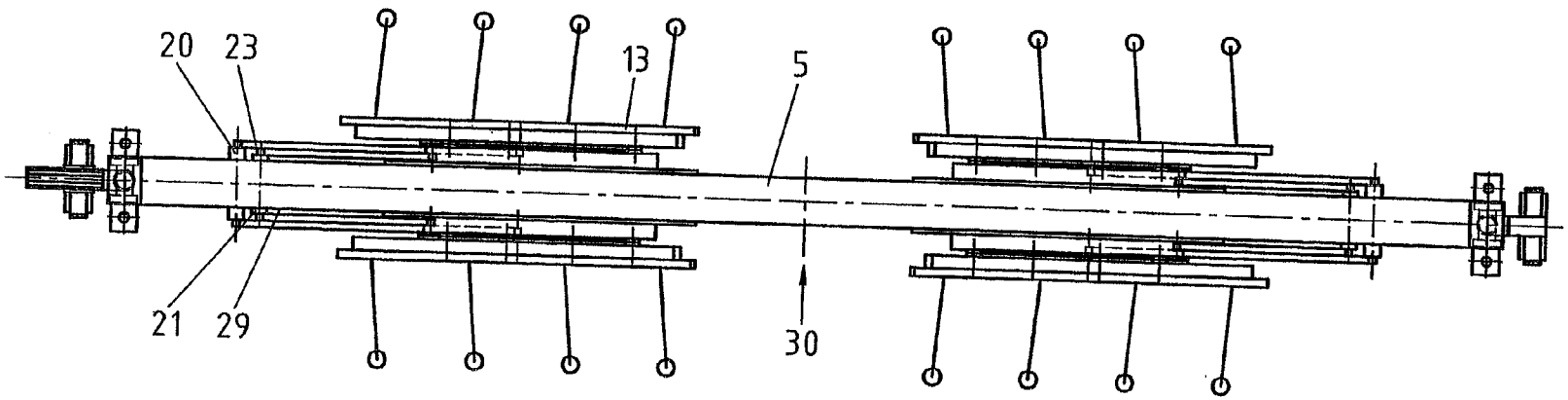

FIGS. 4*a+b* show a plan view of crossmember 5 in a horizontal position and a horizontally sloping position in the component-transporting direction in accordance with arrow 30. The double-sided arrangement of the actuating rods 23, 29 and, in extension thereof, the pivoting and transverse-displacement apparatus are illustrated. Two sucker crossmembers 13 are likewise attached.

Pairs of the actuating rods 23, 29 are fitted in each case on the spindle/nut systems 20, 21, which are provided as a single unit. FIG. 4*b* shows the following further degree of freedom:

horizontally sloping positioning about the vertical axis in or counter to the transporting direction If it is only this sloping position which is required, the function can be performed with an axis of rotation and the compensation in length by spline shaft 14. If, however, the vertically sloping position described in FIG. 2 is likewise envisaged, then the use of a universal joint 15 is necessary. By virtue of this design solution, any desired combination of vertically and horizontally sloping positions is also possible, and thus an sloping positioning in space is provided as the further degree of freedom.

In its maximum inventive configuration, the transporting system proposed may thus carry out workpiece manipulation in the following degrees of freedom.

Vertical movement upward and downward horizontal movement in and counter to the transporting direction pivoting of the crossmember and sucker crossmember in and counter to the transporting direction vertically sloping positioning of the crossmember and sucker crossmember pivoting of the sucker crossmember in the direction transverse to the transporting direction transverse displacement of the sucker crossmember horizontally sloping positioning of the crossmember and sucker crossmember in and counter to the transporting direction sloping positioning of the crossmember and sucker crossmember in space The invention is not restricted to the exemplary embodiment which has been described and illustrated. It also covers all expert configuration within the scope of this disclosure. Thus, a universal joint is only to be understood by way of example as a movable mounting, and it is possible to use all spherical joints which satisfy the requirements of the inventive idea.

As has been explained, it is possible, during the transportation of single components, to dispense with a separate pivotable sucker crossmember 13 and to use crossmember 5 directly as sucker crossmember.

LIST OF DESIGNATIONS

1 Multi-stage press for large components
2 Transporting apparatus
3 Press upright
4 Pivoting arm
5 Crossmember
6 Pivoting drive
7 Lifting drive
8 Forming stage
9 Forming stage
10 Drive
11 Toothed-belt drive
12 Axis of rotation
13 Sucker crossmember
14 Spline shaft
15 Universal joint
17 Bearing block
18 Drive
19 Drive
20 Spindle and nut
21 Spindle and nut
22 Separating location
23 Rod
24 Circle segment
25 Point of rotation
26 Guide
27 Horizontal slide
28 Guide
29 Rod
30 Component-transporting apparatus

What is claimed is:

1. An apparatus for transporting and changing the position of a single or double workpiece in a press, pressline or multi-stage press for large components having a processing station, the processing station comprising:

an independent transporting apparatus, the independent transporting apparatus including:

a pivot drive;

a pivot arm operatively connected to the pivot drive;

a disengageable cross-member pivotably mounted to the pivot arm;

a sucker-cross member movably mounted on the cross-member;

a slide is mounted in a linear guide, the linear guide positioned on the cross-member, said slide movable in a horizontal direction; and a circle segment coupled to the sucker cross-member, wherein the circle segment is guided by segment guides, the segment guides disposed on the slide.

2. The apparatus according to claim 1, wherein the disengageable cross-member forms a universal joint.

3. The apparatus according to claim 1, further comprising:

at least one rod operatively connected to the slide;

a spindle/nut system operatively connected to the at least one rod; and a drive mechanism for driving the spindle/nut system, wherein said rod is engaged by the spindle/nut system allowing the at least one rod to impart force on the slide allowing horizontal movement of the slide.

4. The apparatus according to claim 3, wherein the circle segment is pivotable through engagement by the rod-and the spindle/nut system, by the drive.

5. The apparatus according to claim 3, wherein the drive mechanism is operatively coupled to the-transporting apparatus via a spline shaft.

6. The apparatus according to claim 5, wherein the spline shaft is displaceable horizontally in the transporting apparatus.

7. The apparatus according to claim 3, wherein the disengageable crossmember is disengageable from the transporting apparatus at a separating location.

8. The apparatus according to claim 5, wherein following disengagement of the disengageable crossmember, the drive mechanism is connected to the transporting apparatus via the spline shaft, a universal joint, and a bearing block.

9. The apparatus according to claim 3, wherein the sucker crossmember, the slide, the linear guide, and the rod are fitted on both sides of the disengageable crossmember and is driven jointly via the spindle/nut system and the drive mechanism.

10. The apparatus according to claim 3, wherein the sucker crossmember, the circle segment, the segment guides, and the rod are fitted on both sides of the disengageable crossmember and are driveable jointly via the spindle/nut system and the drive mechanism.

* * * * *